US009393169B1

(12) United States Patent
Schiro

(10) Patent No.: US 9,393,169 B1
(45) Date of Patent: Jul. 19, 2016

(54) SUPINE PATIENT TRANSFER PACKAGE

(71) Applicant: Patricia Schiro, Severna Park, MD (US)

(72) Inventor: Patricia Schiro, Severna Park, MD (US)

( * ) Notice: Subject to any disclaimer, the term of this patent is extended or adjusted under 35 U.S.C. 154(b) by 0 days.

(21) Appl. No.: 14/951,039

(22) Filed: Nov. 24, 2015

(51) Int. Cl.
*A61G 7/10* (2006.01)

(52) U.S. Cl.
CPC ..... *A61G 7/1026* (2013.01)

(58) Field of Classification Search
CPC ..... A47G 9/02; A47G 9/04; A61G 1/01; A61G 7/1025; A61G 7/1026; A61F 5/485
See application file for complete search history.

(56) References Cited

U.S. PATENT DOCUMENTS

| | | | | |
|---|---|---|---|---|
| 3,576,039 | A * | 4/1971 | Roberts | A61F 5/485 5/484 |
| 3,620,894 | A * | 11/1971 | Oates | A61F 5/485 156/253 |
| 3,761,973 | A * | 10/1973 | Leventhal | A61F 5/485 5/484 |
| 5,920,929 | A * | 7/1999 | Hensley | A61G 7/1023 5/485 |
| 6,349,432 | B1 * | 2/2002 | Scordato | A61G 5/006 5/81.1 HS |
| 7,096,524 | B1 * | 8/2006 | Cazzini | A47G 9/0238 5/486 |
| 7,159,257 | B1 | 1/2007 | Struthers | |
| 8,307,478 | B2 | 11/2012 | Patterson et al. | |
| 8,640,279 | B2 | 2/2014 | Koger et al. | |
| 9,101,521 | B2 | 8/2015 | White et al. | |
| 2005/0103350 | A1 * | 5/2005 | Henry | A61G 7/001 128/869 |
| 2011/0072579 | A1 * | 3/2011 | Receveur | A61G 7/1026 5/81.1 HS |
| 2011/0277234 | A1 | 11/2011 | Jasani | |

OTHER PUBLICATIONS

"Stryker Glide Lateral Air Transfer" product described at https://www.stryker.com/en-us/products/ PatientHandlingEMSandEvacuationEquipment/Transfer/GlideLateralAirTranfer/index.htm. Website printed on Nov. 23, 2015.
"AirPal Air-Assisted Lateral Patient Transfer System" described at www.airpal.com. Website printed on Nov. 23, 2015.
"EZ Matt" product described at http://www.ezlifts.com/products/product_details.cfm?ProductID=27. Website printed on Nov. 23, 2015.
"HoverMatt Air Transfer System" described at http://www.hovermatt.com/hovermatt.html. Website printed on Nov. 23, 2015.
"Prevalon Liftaem Mobile Patient Transfer System" described at http://www.sageproducts.com/lit/22649_LiftaemBrochure.pdf. Website printed on Nov. 23, 2015.

(Continued)

*Primary Examiner* — Nicholas Polito
(74) *Attorney, Agent, or Firm* — Larry J. Guffey, Esq.; Pamela K. Rieweds, Esq.; Oliver & Grimsley, LLC

(57) ABSTRACT

A patient transfer package for laterally transferring a supine patient between adjoining horizontal surfaces includes: (a) a first nonwoven sheet having a top and a bottom surface for which the coefficient of friction of the top surface is less than 50% of the coefficient of friction of the bottom surface, (b) a second nonwoven sheet that is similarly constructed as the first sheet but which is not as wide, (c) assembling these sheets into a package with the second sheet turned upside down and laid on top of the first sheet whose top surface is facing upward, (d) a specified percentage of the first sheet's side portions extends beyond the edges of the second sheet and turn upwards and over upon the bottom surface of the second sheet, and (f) a means for temporarily and releaseably attaching the first sheet's edges to the bottom surface of the second sheet.

20 Claims, 4 Drawing Sheets

(56) References Cited

OTHER PUBLICATIONS

"Superior Comfort Patient Transfer Pad" described at http://stretcherpads.com/superiorcomfortpatienttransferpad.aspx. Website printed on Nov. 23, 2015.
"Z-Slider Patient Transfer Sheet" described at http://www.sandelmedical.com/products.asp?id=799. Website printed Nov. 23, 2015.
"EZ Slide Sheet" product described at http://www.ezlifts.com/products/product_details.cfm?ProductID=34. Website printed on Nov. 23, 2015.
"PATRAN Disposable Slide Sheet" described at www.patran.net. Website printed on Nov. 23, 2015.
"HandyTube Manual Transfer Aid" described at http://www.hillrom.com/usa/Products/Category/Patient-Handling/Manual-Transfer-Aids/HandyTube/. Website printed on Nov. 23, 2015.
"Repositioning Slide Chuck System" product described at http://www.mcauleymedical.com/repositioning_chuck_slide.php. Website printed Nov. 23, 2015.
"Slipp Patient Moving Device" product described at http://www.wrightproductsinc.com/About/. Website printed on Nov. 23, 2015.
"PowerNurse Transfer Options" product described at http://www.astirtechnologies.com/brochure/astir%20brochure%205.pdf. Website printed at Nov. 23, 2015.
"SafeTTrans Lateral Transfer System" product described at http://www.servicemed.eu/index.php?option=com_content&view=article&id=186&Itemid=209&lang=en. Website printed on Nov. 24, 2015.
"Safe Patient Handling and Movement (SPHM)" product described at http://mediglider.com/. Website printed on Nov. 24, 2015.
"Glide Lateral Air Transfer System" product described at https://patienthandling.stryker.com/en/products/other-products/glide-lateral-air-transfer-system. Website printed Nov. 24, 2015.
"Samarit Transglide Plastic Lateral Transfer Boards" product described at https://www.mcauleymedical.com/transglide.php. Website printed Nov. 24, 2015.
"Samarit Rollboard" product described at https://www.mcauleymedical.com/Samarit_Rollbord.php. Website printed Nov. 24, 2015.
"UltraSlick Transfer Board" product described at www.ultraslick.com. Website printed Nov. 24, 2015.
"SystermRoMedic EasyGlide, Oval" product described at http://www.handicare.com/us/products/transfer-and-lifting/safe-patient-handling/for-manual-transfers/supine-transfers/systemromedic-%E2%80%93-easyglide%2c-oval/c-117/c-17750/p-230. Website printed Nov. 24, 2015.

* cited by examiner

SUPINE PATIENT TRANSFER PACKAGE

BACKGROUND OF THE INVENTION

1. Field of the Invention

The present invention generally relates to beds, bed clothing and a means for aiding a care giver in relocating or laterally transferring a supine patient between adjoining horizontal surfaces. More specifically, the invention is directed to a package of bed clothing that aids a care giver in making consecutive, lateral transfers of a patient between adjoining horizontal surfaces (e.g., from a stretcher to an operating table and then back to the stretcher).

2. Description of the Related Art

In the day-to-day operation of a hospital, many patients are moved. In many instances, patients are ambulatory and can move from a hospital bed to a wheelchair in order to be moved from one area of the hospital to another. However, many patients are not ambulatory. These patients must also be moved with the assistance of a hospital's care givers, i.e., nursing and medical staff. Non-ambulatory patients are often moved from a hospital bed to a gurney that is placed next to the bed and the gurney's height preferably adjusted so that its top, horizontal surface is at the same level as that of the bed (i.e., a lateral transfer). Once the patient arrives on the gurney at the new area, the patient will often need to be moved from the gurney to a different, adjoining horizontal surface.

When a patient undergoes surgery, (particularly elective surgery), the process begins by asking the patient to lie on a gurney in a pre-operative holding area where the patient discusses his/her procedure with his/her surgical team, signs consents, and is generally prepared for surgery. Almost always, before being wheeled into the operating room, the patient is given a sedative, which causes them to be less coordinated, and less able to move well; which is especially relevant in the more debilitated population such as the elderly, the obese, and the injured. It is in this "less physically able" and medicated state that the patient is then asked to move him/her self over to the operating room table once the gurney is locked in place beside it. This seemingly minor request is, in fact, often a gargantuan task for many patients and can be embarrassing, and painful, and uses precious and expensive Operating Room minutes to perform. Frequently the patient is unable to comply, and Operating Room personnel must step in and employ the use of a transfer device, such as a slider board, that entails log rolling the patient in order to place the device under the patient in order to move the patient to the operating room table. These transfer devices, which must be purchased, maintained, and stored when not in use, are sometimes in short supply and can be difficult to locate when needed.

Once the surgery is over, the patient remains under the effect of anesthesia for some time, and Operating Room personnel must then transfer the patient back to the gurney (if out-patient), or hospital bed (if in-patient) that is brought alongside the operating room table. This second transfer is completed as the first; by log-rolling the patient, and using a transfer device.

As a result of all of these lateral transfers, the nursing and medical staff are often needed to help lift and reposition a patent from one horizontal surface to another. There is often some awkwardness involved in these lateral transfers as the care givers are not always able to position their feet under themselves (e.g., they have to stand on the side of the gurney opposite the adjoining bed and stretch forward to help laterally move the patient towards them) in an optimum manner so as to enable them to minimize the stresses that are placed on their backs, etc.

Many prior art devices have been used to assist caregivers in making these lateral transfers. The lateral transfer itself often consists of a patient rolling or being rolled by the care givers from a supine position to a lateral decubitus position (a so called "log roll"), at which time some type of sheet- or board-like device is often placed between the patient and the surface of the bed or gurney, or other surface on which the patient is lying. The patient then rolls or is rolled from this lateral decubitus position back to a supine position onto the device.

At this point, the patient is often only partially on the device. The medical or nursing staff may have to push and/or pull the patient across the device to effect a transfer across the adjoining surfaces. Once on the gurney or a similar transportation device, another log roll may be necessary to remove the device from underneath the patient.

The current devices being used for these lateral transfers are not optimum. These transfers can be stressful and quite uncomfortable for the patient. Evidence for this is being that patients often make remarks such as "I have to move over there now?," "I'm sorry, I can't move for you, I'm embarrassed, but you will have to move me." Additionally, procedural areas are the revenue generating centers of any hospital; avoiding the waste of time in these areas is critical to the mission of the hospital.

Another potential problem is related to the hospital staff or care givers. In moving the patient, the staff must often bend over various surfaces and push and/or pull the patient. Such physical exertions can be dangerous and result in staff injuries and resulting workman's compensation claims. Also, for patients of significant size and/or weight, additional hospital staff may be required for the physical task of moving the patient from one surface to another with the existing transportation devices. These injury and labor force issues can add substantially to the cost of operating a hospital.

There is a need for improved devices and methods to assist care givers in facilitating these patient lateral transfers, and to improve the experience of the patients undergoing these lateral transfers.

SUMMARY OF THE INVENTION

Recognizing the need for improved devices and methods to assist care givers in facilitating patient lateral transfers between adjoining horizontal surfaces, especially in such treatment areas where frequent and predictable lateral transfers occur, the present invention is generally directed to providing such improved methods and devices.

In a preferred embodiment, the present invention is a patient transfer package for laterally transferring a supine patient between adjoining horizontal surfaces (e.g., from a first horizontal surface, the top of a hospital gurney, to a second horizontal surface, the top of an operating table, and then to a third horizontal surface, back onto the gurney or hospital bed) includes: (a) a first, rectangular-shaped nonwoven sheet having a top and a bottom surface and right- and left-side portions and right and left edge and wherein the coefficient of friction of the top surface is less than 50% of the coefficient of friction of the bottom surface, (b) a second, rectangular-shaped nonwoven sheet that is similarly constructed as the first sheet but not being as wide as the first sheet, (c) wherein the first and second sheets are assembled together into a package with the second sheet being turned upside down and laid on top of the first sheet whose top surface is facing upward, (d) wherein only a specified percentage of the first sheet's side portions extend beyond the edges of the second sheet, (e) wherein the first sheet's edges are turned upwards and over upon the bottom surface of the second sheet, and (f) a means for temporarily and releaseably attaching the first sheet's edges to the bottom surface of the second sheet.

In other versions of this embodiment that are intended to provide for at least two lateral transfers, these versions further includes an intermediate sheet having an upper part and a lower part that are fabricated from sheets which have similar physical properties to those described above. In assembling the package of the present invention, this lower part is turned over so that its top surface faces downward and it is then attached to the upper part's bottom surface and this intermediate sheet is located in the package between the first and second sheets.

In this preferred embodiment, the physical properties of these sheets include: a basis weight in the range of 1.0-2.5 ounces/yard, a thickness in the range of $5\times10^{-3}$-$9\times10^{-3}$ inches, a top surface coefficient of friction in the range of 0.1-0.3 and a bottom surface coefficient of friction that is in the range of 2.1-5 times that of the top surface's coefficient of friction. A suitable and commercially available product from which to make these sheets is DuPont "Tyvek® Soft."

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1A:
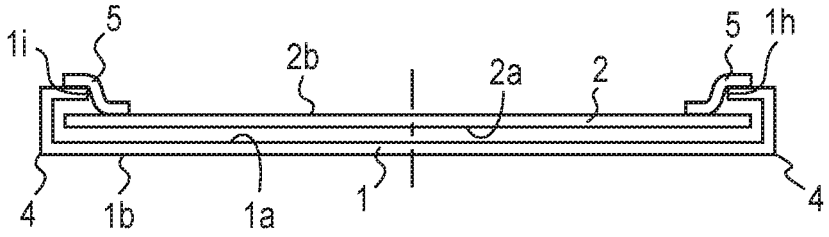
FIG. 1A is an illustrative end view of a single-lateral-transfer version the present invention when it is situated on a horizontal surface in anticipation of being used to assist a care giver in making the required lateral transfer.
Figure 1B:
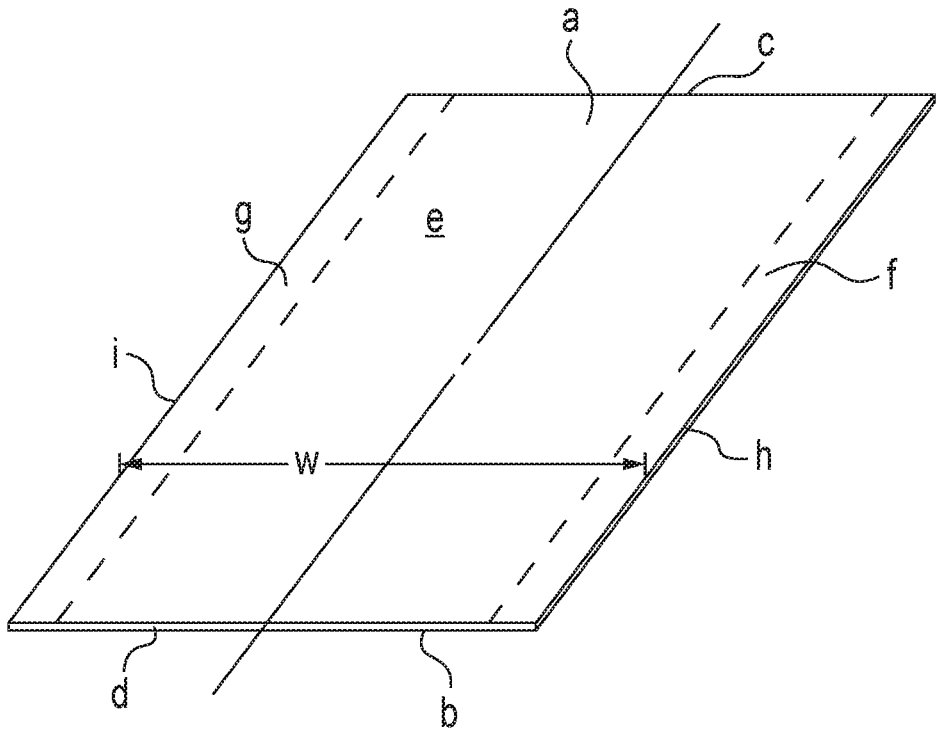
FIG. 1B is an overhead, perspective view of the type of sheet that is used in the present invention and that attempts to indicate the notation that is being used to refer to the different parts of the sheet.
Figure 1C:
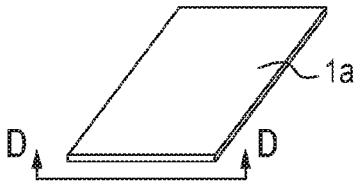
FIG. 1C is an overhead, perspective view of the top, slippery surface for the type of sheet that is used in the present invention.
Figure 1D:
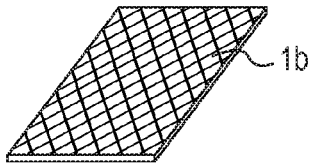
FIG. 1D is a perspective view of the bottom, less slippery or non-slippery surface for the type of sheet that is used in the present invention.
Figure 1E:
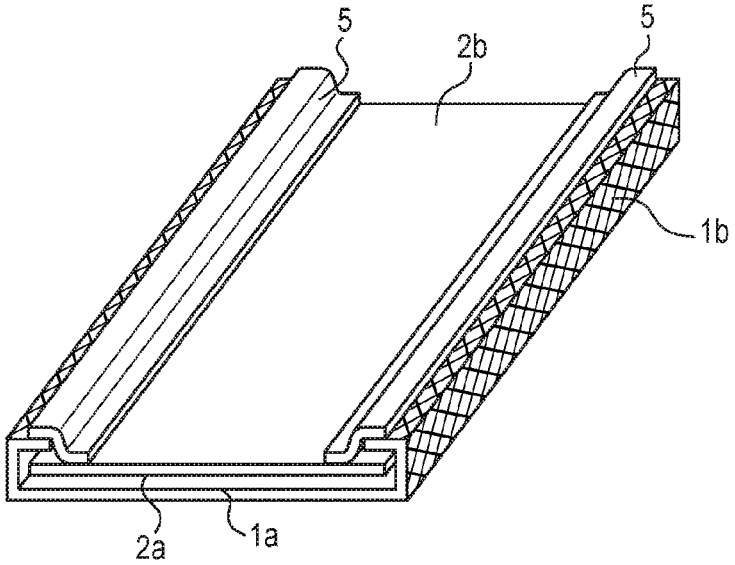
FIG. 1E is an overhead, perspective view of the version of the present invention shown in FIG. 1A and trying to further distinguish the slippery and less slippery or non-slippery sides (denoted by cross-hatching) of the sheets.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The present invention generally relates to a patient transfer package or device for consecutive lateral transfers of a supine patient between adjoining horizontal surfaces (e.g., from a first horizontal surface, the top of a hospital gurney, to a second horizontal surface, the top of an operating table, and then to a third horizontal surface, back onto the gurney. FIG. 1A shows an end view of a single-lateral-transfer version of the present invention when it has been situated on top of a gurney in anticipation of using it to assist the care givers in making the required lateral transfer.

The present invention in general includes a plurality (i.e., two for a single lateral transfer, four for the two lateral transfers, six for three lateral transfers, eight for four lateral transfers, . . . . # sheets required for x lateral transfers=2x) of rectangular-shaped, sheets 1, 2, 3 that are oriented and stacked on top of each other and attached together in a very precise way. Each sheet has distinctive top 1*a*, 2*a*, 3*a* and bottom 1*b*, 2*b*, 3*b* surfaces that have head 1*c*, 2*c*, 3*c* and foot 1*d*, 2*d*, 3*d* ends and between which extends a longitudinal centerline. Each of these sheets also has a middle portion 1*e*, 2*e*, 3*e* right 1*f*, 2*f*, 3*f* and left 1*g*, 2*g*, 3*g* side portions and right 1*h*, 2*h*, 3*h* and left 1*i*, 2*i*, 3*i* edges, and wherein the perpendicular distance between these edges defines the width of each sheet. See FIGS. 1B-1E.

It's helpful to specify the various parts or components of the sheets because of the unique way in which they are packaged together and because these sheets are manufactured in such a way that their physical properties are not uniform within any particular sheet. In particular, the top and bottom surfaces of these sheets differ in their slipperiness or the force, F, required to move them laterally or horizontally when they are fully opened up and lying on a horizontal surface and have a load, L, pressing down upon them from above. Specifically, their top surfaces are considerably more slippery than there bottom; thus, if one of these sheets is oriented so that its top surface is facing down and a load is placed on its upwardly oriented bottom surface, it will be much easier to pull this sheet by its edges horizontally than if the sheet were flipped over and its less slippery bottom side were oriented downward.

The ratio of the required force, F, to pull a body, or in this instance a sheet, laterally and the vertical load, L, on the body or sheet is defined as the coefficient of friction, $c_f$, between the adjoining surfaces ($c_f$=F/L). This ratio has been shown to reach its maximum value in that initial instance when the sheet first begins to slip or move horizontally relative to the surface below—we refer to this as the static coefficient of friction, $c_{fs}=F_i/L$. When the sheet is sliding horizontally at a relatively constant velocity, the force, $F_v$, required to keep it moving at this constant velocity is less than the force, $F_i$, required to initially set it in motion; this force at constant velocity, $F_v$, is used to define the kinetic coefficient of friction, $c_{fk}=F_v/L$.

FIG. 1 shows that a first sheet 1 forms substantially an initial, outer covering for the bedding package or present invention by being initially oriented with its bottom surface 1*b*, the one that is less slippery (i.e., it has both a higher kinetic and static coefficient of friction against the surface on which it is lying) facing downward toward the top of, for example, a gurney. Each of the first sheet's sides 1*h*, 1*i* are folded upwards along a crease 4 that is created parallel to the longitudinal centerline in each of the side portions 1*g*, 1*f* at approximately the same specified, first sheet distance $d_1$ from the sheet's longitudinal centerline. After these edge portions extends upward a desired distance, this sheet's edges are then folded inward so that a fraction of the first sheet proximate each of their edges is folded above and over a specified percentage of the first sheet's side portions 1*f*, 1*g*.

If this bedding package is to be used to provide for only one lateral transfer of a supine patient, it consists of only one additional sheet, a second sheet 2 that forms substantially an initial covering for the top surface 1*a* of the first sheet by being initially oriented with the second sheet's top surface 2*a* facing downward toward the top surface 1*a* of the first sheet. The width (i.e., measured between the sheet's side edges) of this second sheet 2 is less than the width of the first sheet so that the second sheet can be contained within or reside within the first, edges-folded-upward sheet 1.

The first sheet's edges that have been folded inward so that they are folded above and over a specified percentage of the first sheet's side portions 1*f*, 1*g* and also folded over the edges of the second sheet 2*h*, 2*i*. To keep this orientation of these sheets from changing when they are being stored or handled, some means of attachment 5 (e.g., a releasable tape that overlaps the first sheet's edges and has a portion that releaseably attaches to the second sheet's less slippery, upwardly facing, bottom surface 2*b*) extends approximately the full length of the sheet and is used to releaseably attach the edges of the first sheet 1*h*, 1*i* to the second sheet at a point that is very close or proximate to its edges 2*h*, 2*i*.

When in use and placed on, for example, a gurney, and prior to lateral transfer, this two sheet package will have its attached edges released from each other by pulling the releasable attaching tapes when transfer is imminent. In transferring a patient, the second sheet is pulled by one of its edges sideways or laterally with a supine patient lying on top of it. Because it's slipperier top surface 2*a* is facing downward towards the slipperier top surface 1*a* of the underlying sheet, less force is needed to pull the patient who's lying on it laterally or horizontally. The lower the coefficient of friction of these sheet's top surfaces, the less horizontal pulling force is needed.

If this bedding package is to be used to provide for two or more lateral transfers of a supine patient, it will also contain one or more intermediate or third sheets 3 (i.e., an intermediate sheet is needed for each additional lateral transfer beyond the first; thus, if a total of "n" lateral transfers are desired from a bedding package, it will be configured for this purpose so that it has "n−1" intermediate sheets). These intermediate or third sheets 3 are laid out flat and stacked one upon the other between the more slippery faces of the first and second sheets.

Figure 2A:
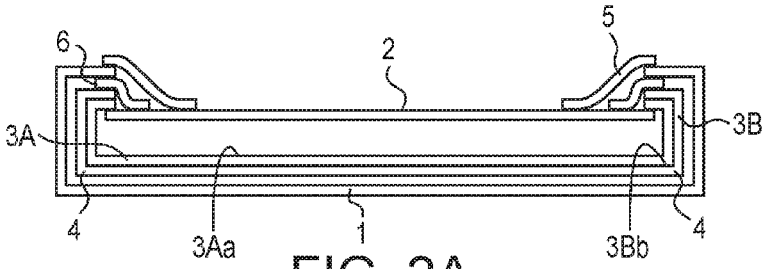
FIG. 2A is an illustrative end view of a double-lateral-transfer version the present invention when it has been situated on a horizontal surface in anticipation of using it to assist the care givers in making the required two lateral transfers.

These intermediate sheets need to slide easily over each other and the underlying top surface 1*a* of the first sheet; therefore, as seen in FIG. 2A, both the top and bottom surfaces of this third sheets needs to be slippery. One could conceivably just use a different manufacturing for this third sheet than was used for the first and second sheets so that such a third sheet would have two slippery surfaces rather than only one slippery surface, i.e., it's top.

However, it has been found that a suitable sheet-like material already exists which has the desired property of a slippery top surface and a less slippery bottom surface. This suitable sheet-like material is actually a specialized commodity product whose cost per square foot is relatively low; thus, it is has been found to actually be more economical to just use two standard, top-side-only-slippery sheets, i.e., an upper part 3A and a lower part 3B made from this already existing sheet-like material, and orient them so their less slippery bottom surfaces 3Ab, 3Bb are facing inward toward each other (i.e., the lower part 3B is turned over so that it's bottom surface 3Bb faces upward) than to change this sheet-like material's manufacturing process so as to produce a specialty third sheet 3 that has two slippery surfaces. The less slippery surfaces 3Ab, 3Bb of the upper and lower parts would typically be attached together (e.g., by sewing, gluing, bonding or taping together) to prevent any relative movement between them.

FIG. 2A shows an illustrative end view of a double-lateral-transfer version the present invention that utilizes one of these intermediate sheets 3 when this bedding package has been situated on top of a gurney in anticipation of using it to assist the care givers in making the required two lateral transfers. The upper part 3A of this third sheet 3 forms substantially an initial covering for the center portion of the lower part's bottom surface 3Bb by being initially oriented with the upper part's bottom surface 3Ab facing downward toward the bottom surface 3Bb of the lower part. Creases 4 in the lower part 3B that are created by turning up the lower part's edges 3Bi, 3Bh so that they can then be turned inward, above and over the edges 2*h*, 2*i* of the second sheet's upwardly directed bottom surface 2*b* in order to provide an overlaying portion to which an attachment means 6 can be used to temporarily releaseably attach the lower part's edges 3Bi, 3Bh to the bottom surface 2*b* of the second sheet at points that are proximate it's edges 2*h*, 2*i*. Meanwhile, the first sheet is oriented as before such that its edges 1*h*, 1*i* turn upward and then inward and are also attached with an attachment means 5 to the bottom surface 2*b* of the second sheet at points that are proximate it's edges 2*h*, 2*i*.

Figure 2B:
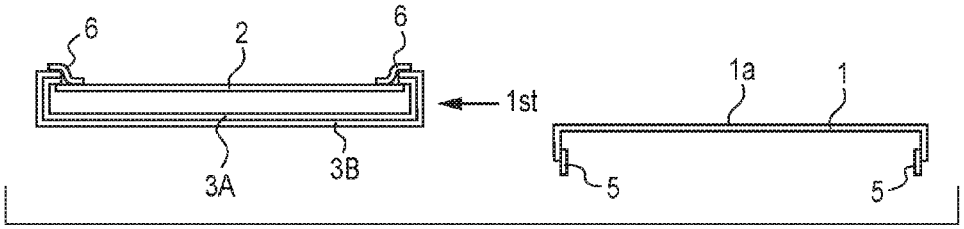
FIG. 2B is an illustrative end view of the FIG. 2A version at a point in time after the first lateral transfer has been made and the first sheet remains on the original horizontal surface on the right and the intermediate sheet and its contents have been transferred to the left to a second horizontal surface.

To demonstrate how this package enables two lateral transfers, FIG. 2B shows an illustrative end view of a the various elements of the double-lateral-transfer version the present invention at a point in time when the first sheet's edges 1*h*, 1*i* have been unattached from the second sheet 2 and allowed to hang down so as to provide full access to the intermediate sheet 3 which had been contained within the first sheet 1 and has subsequently been grasped by its lower part's left edge 3Bi and laterally pulled to the left in order to complete the first lateral transfer. Because the first sheet had its bottom, less slippery surface 1*b* facing the non-slippery top surface of the underlying gurney, the first sheet 1 does not slide to the right with the intermediate sheet 3 and is thus seen to remain to the right on the horizontal top surface of the gurney.

Figure 2C:
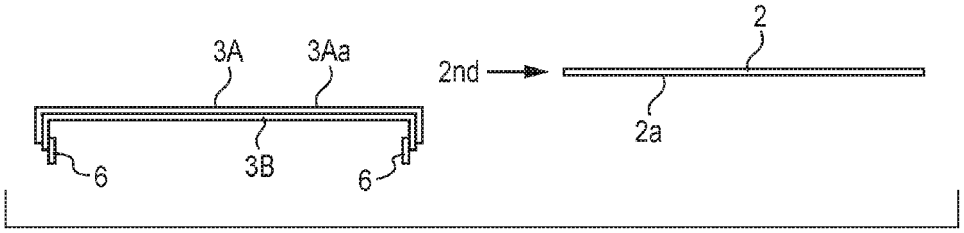
FIG. 2C is an illustrative end view of the FIG. 2A version at a later point in time after the second lateral transfer has been made and the intermediate sheet remains on the horizontal surface on the left and the second sheet has been transferred to the right to a third horizontal surface.

By preplacing this package beneath a supine patient, it should be noted from FIGS. 2B-2C that the usual log-rolling of the patient with every lateral transfer has been eliminated. This is due to the supine patient resting at all times resting only on the second sheet. Beneath it is effectively a stack of intermediate sheets whose number is one less than the number of lateral transfers for which a specific package has been assembled to provide.

FIG. 2C shows an illustrative end view of the intermediate 3 and second 2 sheet of the double-lateral-transfer version the present invention at a later point in time when the lower part of the intermediate sheet's edges 3Bh, 3Bi have been unattached from the second sheet 2 and allowed to hang down so as to provide full access to the second sheet 2 which had been contained within the intermediate sheet 3 and has subsequently been grasped by its right edge 2*h* and laterally pulled to the right in order to complete the second lateral transfer for this package. The intermediate sheet 3 remains on the horizontal surface to the left.

In both of these transfers, it can be seen that the fact that the sheets' surfaces, which were sliding over each other in these two transfers, were their especially configured, slippery surfaces has greatly reduced the magnitude of the lateral forces that had to be applied to accomplish these two lateral transfers.

Figure 3A:
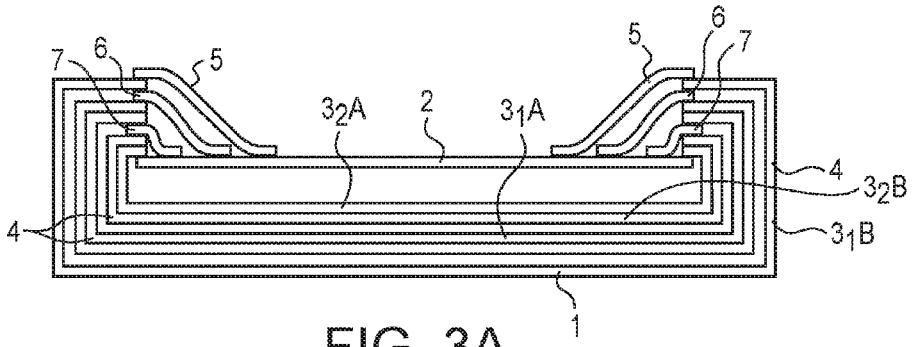
FIG. 3A is an illustrative end view of a triple-lateral-transfer version the present invention when it has been situated on a horizontal surface in anticipation of it being used to assist the care givers in making the required three lateral transfers.

To further illustrate how the bedding packages of the present invention are assembled to enable multiple lateral transfers, FIG. 3A shows an illustrative end view of a triple-lateral-transfer version the present invention that utilizes two $\mathbf{3}_1$, $\mathbf{3}_2$ of these intermediate sheets when this bedding package has been, for example, situated on top of a gurney in anticipation of using it to assist the care givers in making the required three lateral transfers. The upper part of a second intermediate sheet $\mathbf{3}_2$ forms substantially an initial covering for the center portion of the lower part's bottom surface $\mathbf{3}_2$Bb by being initially oriented with the upper part's bottom surface $\mathbf{3}_2$Ab facing downward toward the bottom surface $\mathbf{3}_2$Bb of the lower part. Creases 4 in the lower part $\mathbf{3}_2$B that are created by turning up the lower part's edges $\mathbf{3}_2$Bi, $\mathbf{3}_2$Bh so that they can then be turned inward, above and over the edges 2*h*, 2*i* of the second sheet's upwardly directed bottom surface 2*b* in order to provide an overlaying portion to which an attachment means 7 can be used to temporarily and releaseably attach the lower part's edges $\mathbf{3}_2$Bi, $\mathbf{3}_2$Bh to the bottom surface 2*b* of the second sheet at points that are proximate it's edges 2*h*, 2*i*.

Similarly, the upper part of a first intermediate sheet $\mathbf{3}_1$ forms substantially an initial covering for the center portion of its lower part's bottom surface $\mathbf{3}_1$Bb by being initially oriented with the upper part's bottom surface $\mathbf{3}_1$Ab facing downward toward the bottom surface $\mathbf{3}_1$Bb of the lower part. The lower part's edges $\mathbf{3}_1$Bi, $\mathbf{3}_1$Bh are again turned upward and then inward, above and over the edges 2*h*, 2*i* of the second sheet's upwardly directed bottom surface 2*b* in order to provide an overlaying portion to which an attachment means 6 can be used to temporarily and releaseably attach the lower part's edges $\mathbf{3}_1$Bi, $\mathbf{3}_1$Bh to the bottom surface 2*b* of the second sheet at points that are proximate it's edges 2*h*, 2*i*.

As before, the first sheet is oriented such that its edges 1*h*, 1*i* turn upward and then inward and are also attached with an attachment means 5 to the bottom surface 2*b* of the second sheet at points that are proximate it's edges 2*h*, 2*i*.

Figure 3B:
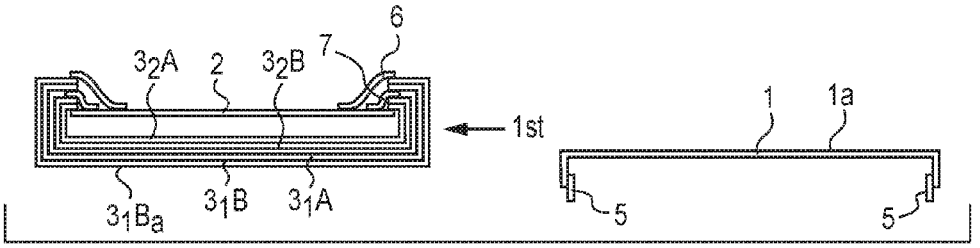
FIG. 3B is an illustrative end view of the FIG. 3A version at a point in time after the first lateral transfer has been made and the first sheet remains on the original horizontal surface on the right and the two intermediate sheets and their contents have been transferred to the left to a second horizontal surface.

To also demonstrate how this triple-lateral-transfer package enables three lateral transfers, FIG. 3B shows an illustrative end view of a the various elements of this triple-lateral-transfer version the present invention at a point in time when the first sheet's edges 1*h*, 1*i* have been unattached from the second sheet 2 and allowed to hang down so as to provide full access to the two intermediate sheets $\mathbf{3}_1$, $\mathbf{3}_2$ which had been contained within the first sheet 1 and wherein the first intermediate sheet $\mathbf{3}_1$ has subsequently been grasped by its lower part's left edge $\mathbf{3}_1$Bi and laterally pulled to the left in order to complete the first lateral transfer. The first sheet 1 is seen to remain on the horizontal surface to the right.

Figure 3C:
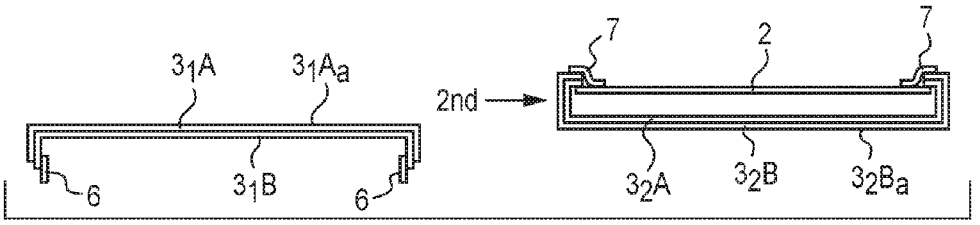
FIG. 3C is an illustrative end view of the FIG. 3A version at a later point in time after the second lateral transfer has been made and the first intermediate sheet remains on the horizontal surface on the left and the second intermediate sheet and its contents have been transferred to the right to a third horizontal surface.

FIG. 3C shows a similar end view at a later point in time when the first intermediate sheet's lower part edges $\mathbf{3}_1$Bh, $\mathbf{3}_1$Bi have been unattached from the second sheet 2 and allowed to hang down so as to provide full access to the second intermediate sheet $\mathbf{3}_2$ which had been contained within the first intermediate sheet $\mathbf{3}_1$ and wherein the second intermediate sheet $\mathbf{3}_2$ has subsequently been grasped by its lower part's right edge $\mathbf{3}_2$Bh and laterally pulled to the right in order to complete the second lateral transfer. The first intermediate sheet $\mathbf{3}_1$ is seen to remain on the horizontal surface to the left.

Figure 3D:
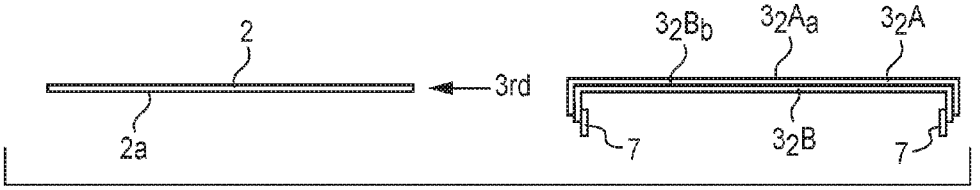
FIG. 3D is an illustrative end view of the FIG. 3A version at a still later point in time after the third lateral transfer has been made and the second intermediate sheet remains on the second horizontal surface on the right and the second sheet has been transferred to the left to a fourth horizontal surface.

FIG. 3D shows a similar end view at a still later point in time when the lower part of the second intermediate sheet's edges $\mathbf{3}_2$Bh, $\mathbf{3}_2$Bi have been unattached from the second sheet 2 and allowed to hang down so as to provide full access to the second sheet 2 which has subsequently been grasped by its left edge 2*i* and laterally pulled to the left in order to complete the third lateral transfer. The second intermediate sheet $\mathbf{3}_2$ is seen to remain on the horizontal surface to the right.

To determine what sort of slipperiness is needed for the top surfaces of these sheets in order for them to be an improvement over standard bed clothing, we begin by examining the coefficient of friction of typical cotton and polyester woven fabrics. It is known that the coefficient of friction for these fabrics can be a function of many fabric parameters, for example: the raw material from which the fabric is made, how the woven fabric is made: its weave (e.g., plain, 2/1 or 3/1 twill), the yarn utilized (e.g., linear density as measured in g/$10^3$ meters of length, threads/cm), level of the fabric's weft setting (e.g., loose, medium, tight), and the weight per square foot of the fabric, and the conditions under which the tests are conducted (e.g., load applied & constant velocity used in the tests). For many types of plain, woven cotton and polyester fabrics, it has been found that the $c_{fs}$~1.6-1.9 $c_{fk}$ and $c_{fs}$~1.4-1.5 $c_{fk}$, respectively. Hereinafter, we'll average these $c_{fs}$ and $c_{fk}$ values and henceforth refer to only a mean coefficient of friction, $c_{fm}$.

For many types of plain, woven cotton fabrics, it has also been found that the $c_{fm}$~0.7-0.9. Similarly, for many polyester fabrics, it has been found that $c_{fm}$~0.3-0.4. Assuming that we can average these values for a blended cotton & polyester sheet, thus, we estimate that a 55%/45% cotton/polyester blended fabric will have a $c_{fm}$~0.5. This data suggests that a sheet-like material, with sufficient tensile strength and a top surface with a mean coefficient of friction in the range of 0.1 or less to 0.3, could be used in the manner described above as a patient lateral transfer device that would greatly reduce the lateral force that must be exerted by care givers required to move a supine patient. Because of health and sanitation concerns, it would also be desirable that this sheet-like material have a manufacturing cost that would make it economically reasonable to use any sheets made from this material only once.

After considerable experimentation with a wide range of fabrics, it was found that the DuPont "Tyvek® Soft" product (e.g., Type 1443R with a basis weight of 1.25 ounces/yd$^2$ and a thickness of only approximately 0.006 inches) appears to be an ideal material from which to fabricate the desired sheets of the present invention. Tyvek® is a nonwoven product brand of a polyethylene (i.e., high density polyethylene, HDPE) synthetic material. The material is made by a flash spinning process in which the polymer is dissolved in a suitable solvent and extruded as a sheet-like structure. As the polymer leaves the extruder, the solvent boils and creates bubbles in the sheet and the polymer between these bubbles solidifies to form a web of ultra fine fibers. To bond the web together, a calendaring process is used that usually involves the use of a smooth roller on the bottom of the web and a engraving roller on the top of the web and which gives the top surface of the web it's characteristic engraved appearance and its nonwoven fabric structure that results in a fabric that is flexible and soft. Some additional downstream finishing techniques (e.g., corona and anti-static treated) may be applied to the web to further improve its physical properties. See U.S. Pat. No. 3,081,519.

The "Tyvek® Soft" product or a similar flashspun, nonwoven polyethylene product is especially appropriate for use in the present invention as they have the following characteristics: good dimensional stability, low linting, superior flexibility, light weight, strong, moisture resistant, withstands deformation, soil, rot, mildew, UV and chemical resistant, and raises no toxicity concerns.

In order to be as economical as possible for use in the present invention, a flashspun, nonwoven polyethylene (including: ultra high molecular weight polyethylene (UHMWPE), high density polyethylene (HDPE), cross linked polyethylene (XLPE), medium density polyethylene (MDPE), linear low density polyethylene (LLDPE), low density polyethylene (LDPE), very low density polyethylene (VLDPE), and copolymers) sheet should ideally have the following physical properties: a basis weight in the range of 1.0-2.5 ounces/yard, a thickness in the range of $5\times10^{-3}$-$9\times10^{-3}$ inches, a top surface coefficient of friction in the range of 0.1~0.3 and a bottom surface coefficient of friction that is in the range of 2.1-5 times that of the top surface's coefficient of friction. Adhesives that work well with the nonwoven polyethylene sheets of the present invention include ethylene/vinyl acetate adhesives, acrylic pressure-sensitive adhesives, polyurethane adhesives, water-based adhesives and natural-product adhesives based on starch, dextrin, casein or animal by-products that provide quick tack and fast drying. See online "DuPont Tyvek Users Manual."

The fact that the present invention is "preplaced" on the horizontal surface on which it is to be used is critical to the overall usefulness of the present invention. No other competitive transfer device on the market is "pre-placed" in anticipation of transfers, layered to facilitate multiple transfers, disposable, and functions as a bed covering. Because of the present invention's preplacement, it eliminates the need for log rolling, and additionally, saves time in locating a transfer device, locating extra personnel, etc. Given the fact that the transfer device is already in place, its use can become part of a scripted, systematic process in moving patients laterally in procedural areas—consequently saving time, and money, and patient dignity, and avoiding employee injuries.

Because it is disposable, the present invention can help to eliminate the need to purchase, store and clean traditional patient transfer devices—especially for operating and emergency room uses where the pre-placement of the double-lateral-transfer version the present invention on the gurney that brings a patient into the room can provide for the quick, easy, safe lateral transfer of patients by the room's staff.

It should be noted that the sheets of the present invention may be made to whatever length and width are required by their ultimate end users. For example, a sheet's length may extend to and beyond the height of a typical patient or may be made in shorter versions or partial sheets.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereafter set forth in the claims to the invention.

I claim:

1. A patient transfer package for laterally transferring a supine patient from one horizontal surface to another horizontal surface, said package comprising:

a first, rectangular-shaped nonwoven sheet having a top and a bottom surface and a head end and a foot end and between which extends the longitudinal centerline for said first sheet, a middle portion, a right side portion and a left side portion and a right edge and a left edge, and wherein the perpendicular distance between said edges defines a first width of said first sheet, and wherein said top and bottom surfaces of said first sheet each have a different coefficient of friction, and wherein the coefficient of friction of said top surface is less than 50% of the coefficient of friction of said bottom surface, a second, rectangular-shaped nonwoven sheet having a top and a bottom surface and a head end and a foot end and between which extends the longitudinal centerline for said second sheet, a middle portion, a right side portion and a left side portion and a right edge and a left edge, and wherein the perpendicular distance between said edges defines a second width of said second sheet, and wherein said top and bottom surfaces of said second sheet each have a different coefficient of friction, and wherein the coefficient of friction of said top surface is less than 50% of the coefficient of friction of said bottom surface, and wherein said first width is greater than said second width, and wherein said first and second sheets are assembled together into a package with said second sheet being turned upside down and laid on top of said first sheet that is oriented so that said top surface of said first sheet is facing upward and so that only a specified percentage of said side portions of said first sheet extend beyond the edges of said second sheet, wherein said edges of said first sheet are turned upwards and over upon the bottom surface of said second sheet, and a means for temporarily and releaseably attaching said first sheet edges to the bottom surface of said second sheet.

2. The patient transfer package as recited in claim 1, further comprising:

an intermediate sheet having an upper part and a lower part, wherein said lower part having a third rectangular-shaped nonwoven sheet having a top and a bottom surface and a head end and a foot end and between which extends the longitudinal centerline for said third sheet, a middle portion, a right side portion and a left side portion and a right edge and a left edge, and wherein said top and bottom surfaces of said third sheet each have a different coefficient of friction, and wherein the coefficient of friction of said top surface is less than 50% of the coefficient of friction of said bottom surface, and wherein said third sheet is oriented as part of said intermediate sheet with the bottom surface of said third sheet turned upward, wherein said upper part having a fourth rectangular-shaped nonwoven sheet having a top and a bottom surface and a head end and a foot end and between which extends the longitudinal centerline for said fourth sheet, a middle portion, a right side portion and a left side portion and a right edge and a left edge, and wherein said top and bottom surfaces of said fourth sheet each have a different coefficient of friction, and wherein the coefficient of friction of said top surface is less than 50% of the coefficient of friction of said bottom surface, and wherein said fourth sheet is oriented as part of said intermediate sheet with the top surface of said fourth sheet facing upward, wherein the bottom surface of said upper part is attached to the bottom surface of said lower part, and wherein said intermediate sheet is located in said package between said first and second sheets.

3. The patient transfer package as recited in claim 2, wherein:

said package is configured such that when said package is to provide for a 'n' lateral transfers, 'n−1' intermediate sheets are placed one upon another in said package.

4. The patient transfer package as recited in claim 1, wherein:

said coefficient of friction of said top surface is in the range of 0.1 to 0.3.

5. The patient transfer package as recited in claim 2, wherein:

said coefficient of friction of said top surface is in the range of 0.1 to 0.3.

6. The patient transfer package as recited in claim 3, wherein:

said coefficient of friction of said top surface is in the range of 0.1 to 0.3.

7. The patient transfer package as recited in claim 1, wherein:

said nonwoven sheet has a basis weight in the range of 1.0-2.5 ounces/yard$^2$ and a thickness in the range of $5\times10^{-3}$-$9\times10^{-3}$ inches.

8. The patient transfer package as recited in claim 2, wherein:

said nonwoven sheet has a basis weight in the range of 1.0-2.5 ounces/yard$^2$ and a thickness in the range of $5\times10^{-3}$-$9\times10^{-3}$ inches.

9. The patient transfer package as recited in claim 3, wherein:

said nonwoven sheet has a basis weight in the range of 1.0-2.5 ounces/yard$^2$ and a thickness in the range of $5\times10^{-3}$-$9\times10^{-3}$ inches.

10. The patient transfer package as recited in claim 4, wherein:

said nonwoven sheet has a basis weight in the range of 1.0-2.5 ounces/yard$^2$ and a thickness in the range of $5\times10^{-3}$-$9\times10^{-3}$ inches.

11. The patient transfer package as recited in claim 5, wherein:

said nonwoven sheet has a basis weight in the range of 1.0-2.5 ounces/yard$^2$ and a thickness in the range of $5\times10^{-3}$-$9\times10^{-3}$ inches.

12. The patient transfer package as recited in claim 6, wherein:

said nonwoven sheet has a basis weight in the range of 1.0-2.5 ounces/yard$^2$ and a thickness in the range of $5\times10^{-3}$-$9\times10^{-3}$ inches.

13. The patient transfer package as recited in claim 4, wherein:

said bottom surface of said nonwoven sheet has a coefficient of friction that is in the range of 2.1-5 times that of the coefficient of friction of said top surface.

14. The patient transfer package as recited in claim 5, wherein:

said bottom surface of said nonwoven sheet has a coefficient of friction that is in the range of 2.1-5 times that of the coefficient of friction of said top surface.

15. The patient transfer package as recited in claim 6, wherein:

said bottom surface of said nonwoven sheet has a coefficient of friction that is in the range of 2.1-5 times that of the coefficient of friction of said top surface.

16. The patient transfer package as recited in claim 10, wherein:

said bottom surface of said nonwoven sheet has a coefficient of friction that is in the range of 2.1-5 times that of the coefficient of friction of said top surface.

17. The patient transfer package as recited in claim 11, wherein:

said bottom surface of said nonwoven sheet has a coefficient of friction that is in the range of 2.1-5 times that of the coefficient of friction of said top surface.

18. The patient transfer package as recited in claim 12, wherein:

said bottom surface of said nonwoven sheet has a coefficient of friction that is in the range of 2-5 times that of the coefficient of friction of said top surface.

19. The patient transfer package as recited in claim 1, wherein:

said nonwoven sheet is made from a flashspun, nonwoven polyethylene soft product.

20. The patient transfer package as recited in claim 18, wherein:

said nonwoven sheet is made from a flashspun, nonwoven polyethylene soft product.

* * * * *